United States Patent [19]

Siekanowicz et al.

[11] 4,263,529

[45] Apr. 21, 1981

[54] MODULATOR WITH VARIABLE LAUNCH CONDITIONS FOR MULTI-ELECTRON GUN DISPLAY DEVICES

[75] Inventors: Wieslaw W. Siekanowicz, Lawrenceville; John R. Fields, Cranbury, both of N.J.

[73] Assignee: RCA Corp., New York, N.Y.

[21] Appl. No.: 87,451

[22] Filed: Oct. 22, 1979

[51] Int. Cl.[3] ..... H01J 29/46; H01J 29/48

[52] U.S. Cl. ..... 313/422; 315/366

[58] Field of Search ..... 313/422

[56] References Cited

U.S. PATENT DOCUMENTS

| | | | |
|---|---|---|---|
| 4,088,920 | 5/1978 | Siekanowicz et al. | 313/422 |
| 4,128,784 | 12/1978 | Anderson | 313/422 |

OTHER PUBLICATIONS

Anderson et al., Copending Appl. Ser. No. 921,267, filed Jul. 3, 1978.

*Primary Examiner*—Robert Segal

*Attorney, Agent, or Firm*—Eugene M. Whitacre; Dennis H. Irlbeck; Lester L. Hallacher

[57] ABSTRACT

An evacuated envelope is divided into a plurality of electron propagation channels. Each channel includes an electron gun section and a beam guide section. The electron gun section provides electrons in the form of beams to the guide section. The guide section includes spaced guide meshes and the electrons are propagated along the channel in the space between the guide meshes. A launch section, in the form of at least one pair of launch electrodes, is arranged between the electron gun section and the beam guide section. The conditions under which electrons leave the gun section and enter the guide section are selected by the application of selected voltages to the launch electrodes.

7 Claims, 2 Drawing Figures

MODULATOR WITH VARIABLE LAUNCH CONDITIONS FOR MULTI-ELECTRON GUN DISPLAY DEVICES

BACKGROUND OF THE INVENTION

The present invention relates generally to a flat panel display device having a plurality of electron guns for providing electron beams to electron beam guides and particularly to such a display device in which the beam guides include means for modulating the electron beams.

U.S. Pat. No. 4,088,920 to W. W. Siekanowicz et al, entitled "*Flat Display Device With Beam Guide*", describes a beam guide for use in flat panel cathodoluminescent display devices. The display is composed of an evacuated envelope containing a plurality of internal support walls which divide the envelope into a plurality of parallel channels. Each channel contains a beam guide extending along one wall of the envelope. An electron gun structure emits electrons which are launched into the beam guides as electron beams. The beam guides include a pair of spaced parallel plates extending along and spaced from the back wall of the envelope. The plates have a plurality of aligned apertures therethrough with the apertures being arranged in columns extending longitudinally along the paths of the beams. Each longitudinal column of apertures constitutes a separate beam guide. The apertures also are arranged in rows transversely of the guides. One line of the visual display is generated by ejecting the electron beams out of the guide through the apertures in a single row.

Copending Application Ser. No. 921,267 filed July 3, 1978 by Charles H. Anderson et al, entitled "*Guided Beam Display Device*", discloses a flat panel display including multiple beam channels each of which encloses guide meshes extending along the length of the channels. Each of the channels includes modulation electrodes and cathode means which provide modulated electron beams to the guide meshes. Tabs are included on the guide meshes to determine the area where the electrons leave the cathode and enter into the beam guides. The guide meshes extend between the modulation electrodes so that the modulation electrodes partially overlap the beam guides. This overlap eliminates the deleterious effect of differences in the contour or misalignment of the edges of the modulation electrodes. The Anderson et al device therefore alleviates the problems of maintaining precise modulation electrode configuration, dimensions and spacing with respect to the cathode. However, the device does not permit the selection of the electron launching conditions independently of the conditions required for the operation of the cathode and modulation electrodes.

SUMMARY OF THE INVENTION

A flat panel display device includes an evacuated envelope. The envelope encloses beam guides and cathode means which provide electrons to the beam guides. Electron launch electrodes establish the conditions at which the electrons are launched from the cathode means to the beam guides. The beam guides include apertures through which electrons can pass. The beam guides are positioned so that at least one of the apertures lies between the launch electrodes.

DETAILED DESCRIPTION OF THE PREFERRED EMBODIMENT

Figure 1:
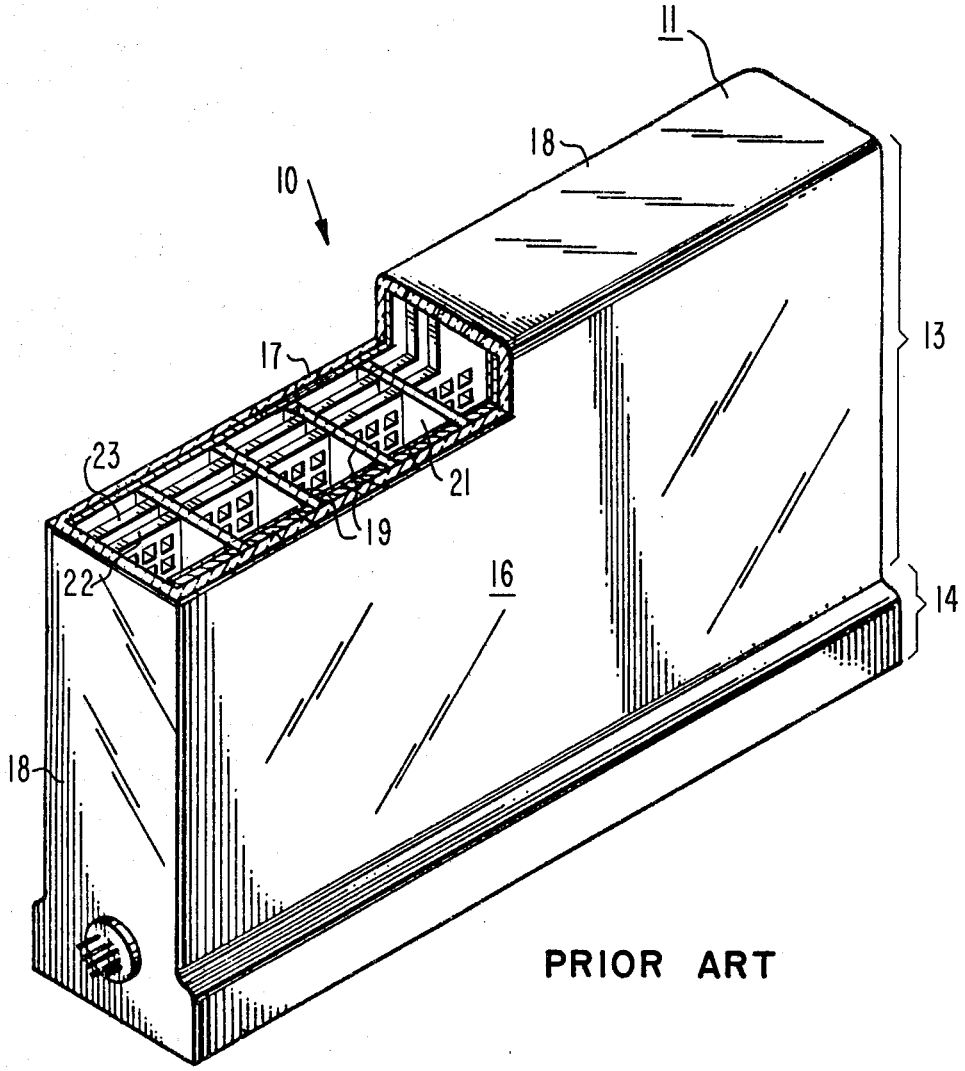
FIG. 1 is a perspective view partially broken away of a prior art display device in which the invention can be used.

FIG. 1 shows one form of a flat panel display device in which the present invention can be utilized. The display device is generally designated as 10 and includes an evacuated envelope 11 having a display section 13 and an electron gun section 14. The envelope 11 includes a rectangular front wall 16 and a rectangular back wall 17 in spaced parallel relationship with the front wall 16. The front wall 16 and the back wall 17 are connected by four sidewalls 18.

A plurality of spaced parallel support vanes 19 are secured between the front wall 16 and the back wall 17 and extend from the gun section 14 to the opposite sidewall 18. The support vanes 19 provide the desired internal support against external atmospheric pressure and divide the envelope 11 into a plurality of channels 21. Each of the channels 21 encloses a beam guide assembly of the type described in U.S. Pat. No. 4,088,920. The beam guide assemblies include a pair of spaced parallel beam guide meshes 22 and 23 extending transversely across the channel 21 and longitudinally along the channel from the gun section 14 to the opposite sidewall 18. The construction and operation of the display device 10 shown in FIG. 1 are fully described in U.S. Pat. No. 4,088,920 and copending Application Ser. No. 921,267.

Figure 2:
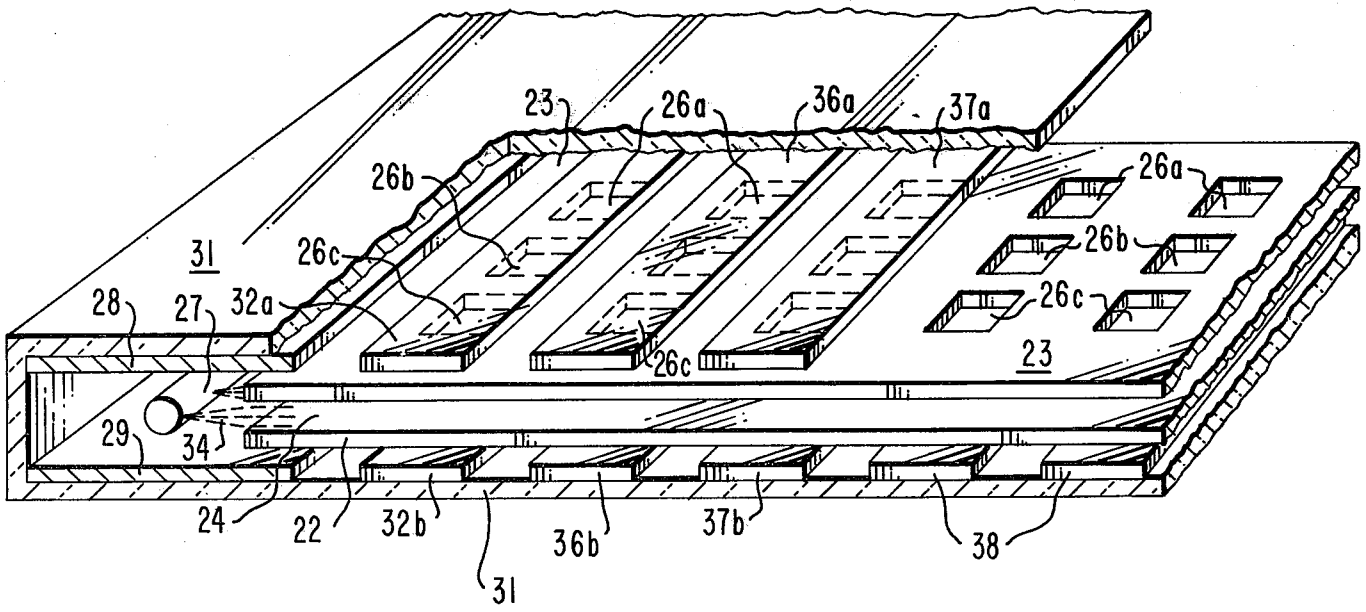
FIG. 2 is a perspective view of a preferred embodiment of the invention.

The preferred embodiment shown in FIG. 2 includes the guide beam meshes 22 and 23 in a spaced parallel relationship to form a space 24 therebetween. The guide mesh 23 includes a plurality of apertures **26*a*, 26*b* and 26*c*. Although they are not shown, guide mesh 22 also contains apertures which are aligned with the apertures in the guide mesh 23. The apertures labeled 26*a* are arranged longitudinally along the mesh 23 so that these apertures from a column extending longitudinally along the length of the guide mesh 23. In similar fashion the apertures labeled 26*b* and 26*c* form two additional columns of apertures along the length of the mesh 23. The three columns of apertures form three electron beam paths so that three electron beams can be propagated between the guide meshes for the full length of the channel 21. The apertures also are arranged in rows extending transversely across the meshes 22 and 23. Accordingly, each row contains three apertures labeled 26*a*, 26*b* and 26*c***.

A cathode 27 is positioned substantially coincident with the center of the space 24 between the guide meshes 22 and 23. The cathode 27 is positioned between a pair of modulation electrodes 28 and 29 which are supported by an insulating housing 31 so that the modulation electrodes 28 and 29 are held in a spaced, substantially parallel, relationship. The ends of the guide meshes 22 and 23 where electrons enter the space 24 also extend between the modulation electrodes 28 and 29.

An electron launch electrode **32*a* is supported by the upper portion of insulating support 31 in spaced relationship with the guide mesh 23 directly above the row of apertures closest to the cathode 27**. A second electron launch electrode 32*b* is supported by the bottom portion of insulating support 31 in spaced relation to the guide mesh 22 directly beneath the launch electrode 32*a*. The two launch electrodes 32*a* and 32*b* are substantially equally spaced from the center line of the space 24 between the meshes 22 and 23. The two electrodes 32*a* and 32*b* form a first pair of launch electrodes which spans the first row of apertures in the guides 22 and 23. For this reason, voltages on the launch electrodes 32*a* and 32*b* create an electric field which extends through the apertures 26*a*, 26*b* and 26*c* in the guide meshes 22 and 23 to form an electrostatic lens which is used to adjust the launch conditions of the electron beam 34.

A second launch electrode 36*a* is supported by the upper portion of support 31 in a position directly above the second row of apertures in the guide mesh 23. A mating launch electrode 36*b* is positioned directly beneath the launch electrode 36*a* and the second row of apertures in the guide meshes 22 and 23. These two launch electrodes form a second pair and permit further selection of the electron launch conditions.

A third pair of launch electrodes, composed of electrodes 37*a* and 37*b*, is positioned so that the third row of apertures in the guide meshes 22 and 23 lies directly between the two electrodes 37*a* and 37*b* which form the third pair.

Extraction electrodes 38 also are supported by the lower portion of the insulating support 31 in positions directly beneath the fourth and subsequent rows of apertures in the guide meshes 22 and 23.

In operation the cathode 27 is energized to an elevated temperature so that a stream of electrons 34 is emitted by the cathode and enters into the space 24 between the guide meshes 22 and 23. Adjustment of the voltages on the launch electrode pairs 32*a*–32*b*, 36*a*–36*b* and 37*a*–37*b* varies the launch conditions, such as the beam thickness and width and transverse velocity, of the electron beams. After propagating between the guide meshes 22 and 23 for the distance required to pass all launch electrode pairs, the electron beams pass over the first extraction electrode 38 and the operation of the device is then the same as that described in the above referenced prior art teachings.

The device illustrated in FIG. 2 can be considered to be in three sections. The first section is the electron gun section and includes the cathode 27 and the modulator plates 28 and 29. The cathode supplies electrons for the electron beams 34 and the modulation electrodes modulate the beams with the information to be displayed. The second section is the launching section and includes the launch electrode pairs 32*a*–32*b*, 36*a*–36*b* and 37*a*–37*b* which are in alignment with and span the first several transverse rows of apertrues 26*a*, 26*b* and 26*c* contained within the guide meshes 22 and 23. The third section is the beam guide section and includes the guide meshes 22 and 23, and the extraction electrodes 38 which are positioned directly beneath the transverse rows of extraction apertures.

In presently known systems, the configuration of the electron beams is dependent upon the cathode diameter, the distance between the cathode and the guide meshes, and the voltages on the guide meshes and modulation electrodes. The selection of these parameters is largely dependent upon the required operational characteristics of the various sections of the system. For example, the cathode size is determined by a compromise between heating power and voltage drop produced by electron emission and resistance of the cathode. The spacing between the cathode and guide meshes is determined by the need to maintain sufficient spacing to keep the guide meshes from being adversely affected by the heat from the cathode and by achievement of the desired relationship between current in the beam, the voltages on the modulating electrodes and the guide meshes. The modulation electrode voltage must be selected to turn the electron gun on and off. The guide mesh voltage must coact with the extraction electrode voltage and other voltages, as described in U.S. Pat. No. 4,088,920, to focus the electron beams during propagation between the guide meshes. For these reasons, there is very little ability to select the conditions with which the electrons are launched. The invention overcomes the difficulty by providing additional lenses, each of which can be selected to focus and shape the electron beams and to improve the transmission efficiency of the system. As is known to those skilled in the art, the electrostatic lenses which focus electron beams are primarily dependent upon the differences in the voltages on the adjacent electrodes which carry the two voltages. The greater the voltage difference, the more influence the lens has on the electron beam. In the system described herein an einzel lens is established at the location of the launch electrode pair 32*a*–32*b* by applying a +375 volt potential to launch electrodes 32*a* and 32*b*. An einzel lens is a two-potential lens, such as that described in J. R. Pierce, "*Theory and Design of Electron Beams*", D. Van Nostrand Co., Inc., New York, 1954, pgs. 98–101. The einzel lens is formed by the penetration of the launch electrode potential through the apertures 26*a*, 26*b* and 26*c* in the guide meshes 22 and 23, and by the potentials established on either side of the apertures by the potential on the guide meshes. The einzel lens coverages the expanding electron beam emitted by the cathode. A drift region is created between the einzel lens and the onset of normal guide operations by fixing the potential of the electrode pair 36*a*–36*b* to the mesh potential of +70 volts. The launch electrode pair 37*a*–37*b*, if used, also will be biased at the guide mesh potential of +70 volts. The extraction electrodes 38 are biased at a +350 volt potential to provide normal operation of the guide meshes 22 and 23. Due to the einzel lens and the drift region the electron beams enter the space between the guide meshes focused such that the beams remain compact throughout the guide, thereby decreasing the number of electrons which are lost to the guide meshes 22 and 23, and improving the quality of the extracted spot.

In addition to the preferred embodiment described above, which includes an einzel lens followed by a drift region, substantially equivalent performance can be obtained by other choices of potentials for the electrode pairs 32*a*–32*b*, 36*a*–36*b* and 37*a*–37*b*. For example, the electrode pair 32*a*–32*b* can be biased at −20 volts, the electrode pair 36*a*–36*b* at +70 volts and the electrode pair 37*a*–37*b* at +350 volts.

What is claimed is:

1. In a flat panel display device having an evacuated envelope divided into a plurality of channels, said channels including an electron gun section, and an electron beam guide section, said electron gun section including means for providing electron beams and means for modulating said electron beams, said electron guide section including spaced substantially parallel beam guides for receiving said electron beams in the space between said guides and having a plurality of apertures arranged in columns longitudinally along said guides and in rows transversely of said guides, the improvement comprising:

an electron beam launch section positioned between said electron gun section and said electron beam guide section, said launch section including at least one pair of launch electrodes, each of said launch electrodes extending continuously over said beam guides and substantially aligned with one of said rows of apertures.

2. The flat panel display of claim 1 wherein successive rows of said apertures are arranged between successive pairs of said launch electrodes.

3. The flat panel display of claim 2 wherein there are at least two pairs of said launch electrodes so that at least two of said rows of apertures lie between different pairs of said launch electrodes.

4. The flat panel display of claim 2 wherein there are two pairs of said launch electrodes so that the first and second rows of apertures respectively lie between the first and second pair of launch electrodes.

5. The flat panel display of claim 2 wherein there are three pairs of said launch electrodes so that the first, second and third rows of apertures respectively lie between the first, second and third pair of launch electrodes.

6. The flat panel display of claim 2 further including means for applying selected voltages to said pairs of launch electrodes to vary the launch conditions of said electron beams.

7. The flat panel display of claim 3 further including at least two means for individually applying selected voltages to said pairs of launch electrodes to vary the launch conditions of said electron beams.

* * * * *